United States Patent [19]

Richardson

[11] Patent Number: 4,898,004

[45] Date of Patent: Feb. 6, 1990

[54] IN-STORE REFRIGERATED DISPLAY SYSTEM

[76] Inventor: James E. Richardson, 28 Ladder Hill Rd. South, Weston, Conn. 06883

[21] Appl. No.: 336,747

[22] Filed: Apr. 12, 1989

Related U.S. Application Data

[63] Continuation-in-part of Ser. No. 181,921, Apr. 15, 1988, Pat. No. 4,845,957.

[51] Int. Cl.[4] ..... A47F 3/04

[52] U.S. Cl. ..... 62/255; 62/298; 62/457.9

[58] Field of Search ..... 62/246, 255, 257, 298, 62/457.1, 457.9; 312/107; 220/3.1, 4 C, 4 F, 4 R

[56] References Cited

U.S. PATENT DOCUMENTS

| | | | |
|---|---|---|---|
| 2,319,433 | 5/1943 | Phillips | 62/246 X |
| 2,706,387 | 4/1955 | Swanson | 62/255 X |
| 2,793,925 | 5/1957 | Rosen | 62/246 X |
| 2,915,884 | 12/1959 | Haushalter et al. | 62/298 X |
| 3,360,953 | 1/1968 | Duckmann | 62/255 X |
| 4,593,536 | 6/1986 | Fink et al. | 62/239 |

*Primary Examiner*—William E. Tapolcai
*Attorney, Agent, or Firm*—David P. Gordon

[57] ABSTRACT

A refrigerated display system for the in-store display of perishable items is disclosed. The display system comprises a reusable refrigeration unit and a knock-down insulated storage and display unit which may be disposable. The refrigeration unit comprises standard components for colling air, an outgoing and a return duct, and a fan for causing the cooled air to be circulated out the outgoing duct through the knock-down unit and back into the return duct. The insulated knock-down unit is separate from but cooperates with the refrigeration unit, and is arranged for storing perishable items on its inside and for displaying printed material associated with the perishable items on its outside walls. The knock-down unit includes insulated outer walls, a door through which the perishable items may be loaded and removed, a pair of duct openings corresponding to the ducts of the refrigeration unit, and an air plenum having extending ribs for forcing air to the insulated outer walls of the knock-down unit. The outer walls preferably include inwardly extending ribs for creating channels therebetween through which the air can flow. The knock-down unit may comprise walls and plenums of different sizes to permit different sized systems to be created using the same refrigeration unit.

20 Claims, 3 Drawing Sheets

IN-STORE REFRIGERATED DISPLAY SYSTEM

A continuation-in-part of copending U.S. Ser. No. 07/181,921, filed Apr. 15, 1988, now U.S. Pat. No. 4,845,957.

BACKGROUND

This invention generally relates to a refrigerated display system for perishable items. More particularly, this invention relates to an in-store display system for food items which must be refrigerated or frozen, wherein the display system includes a refrigeration unit which is reusable, and an attached insulated storage unit which is either in a knock-down arrangement or disposable, and which, if desired, may be arranged for the particular food item to be displayed.

Promotions of packaged shelf foods and other items in supermarkets typically takes the form of end aisle displays featuring cases of the food or item to be promoted. In the past, such promotions have been limited to non-perishable items. The manufacturers of frozen or refrigerated foods have been unable to participate in such end aisle promotions because refrigeration or freezing is required and freezers and dairy cases do not allow for the addition of large product specific graphic displays surrounding the promoted product. Indeed, freezers and dairy cases are expensive items which are not sized for end aisle displays. Moreover, depending on the size and type of item being sold, efficient use of space cannot necessarily be obtained with the use of freezers and dairy cases.

Various solutions to the problem of providing refrigerated display units have been proposed. One solution provides insulated containers with graphics on casters that are stored in a freezer during the night and wheeled out during the day. The problems with such an arrangement are that store personnel are required to attend to the unit each day, and that refrigeration is uneven with the promoted items being frozen at the beginning of the day, and thawed by the end of the day. Another solution to the refrigerated display unit problem has been for companies to purchase small refrigerators and freezers, to apply the graphics to the units, and then to give the stocked units to the food stores. This solution has not been effective because the units are expensive and are typically not size-efficient. Moreover, after the promotion, the units tend to disappear because they have value to the store personnel or to the store itself.

Yet another proposed solution to the refrigerated display system problem has been to provide a disposable insulated container utilizing a battery operated fan and an air hose. One end of the hose is placed in a freezer chest or a dairy case, and the fan pulls the cold air from the freezer or dairy case into the insulated container and keeps the food items refrigerated in that manner. Again, there are several problems with this solution The unit does not work with vertical freezers with doors. Also, the unit is tied to a freezer or dairy case with a hose which results in the unit being located in the aisle thereby both blocking shopping cart traffic as well as the freezer or dairy case to which the unit is tied. Moreover, such units do not maintain low enough temperatures to keep certain frozen foods, e.g. ice cream, frozen.

Other solutions or related devices known in the art include apparatus disclosed in U.S. Pat. Nos.:

| | | | |
|---|---|---|---|
| 1,871,784 | C. A. Frick et al. | 3,703,088 | C. E. Moorhead |
| 2,030,780 | R. N. Bicknell | 3,730,603 | P. Looms |
| 2,115,048 | W. L. Stewart | 4,203,302 | J. M. Lapeyre |
| 2,502,076 | H. R. Denton | 4,393,659 | Keyes et al. |
| 2,502,589 | L. E. Rabjohn | 4,523,439 | B. A. Denisot |
| 2,793,925 | L. Rosen | 4,572,598 | F. Moore, Jr. |
| 2,915,884 | T. L. Haushalter et al. | 4,593,536 | Fink et al. |
| 3,360,953 | G. W. Dieckmann | 2,319,433 | R. L. Phillips |
| | | 2,706,387 | S. V. Swanson |

While many of the above-listed patents do provide suggested solutions to the problem in the art, it will be appreciated that each of them are unsuitable for many of the same reasons listed above with regard to the other discussed proposed solutions.

SUMMARY OF THE INVENTION

It is therefore an object of the invention to provide a refrigerated system for perishable items which is self-contained, capable of being knocked-down, and which, if desired, may be tailored to the size and type of item which is to be promoted.

It is a further object of the invention to provide a self-contained, cost-effective refrigerated display system for perishable items which does not require the attention of store personnel and which is effective in maintaining its refrigeration.

In accord with the objects of the invention, a refrigerated system for perishable items is provided and generally comprises: (a) a refrigeration unit comprising a cooling means for cooling air, a circulation means for circulating the air around a knock-down insulated storage unit, and at least a first pair of openings in said refrigeration unit for permitting cooled air to flow out of said refrigeration through a first opening of said first pair and for permitting returning air to be received in said refrigeration unit via a second opening of said first pair; and (b) said knock-down insulated storage unit, separate from said refrigeration unit and arranged for being placed together with said refrigeration unit, said knock-down unit further being arranged for storing said perishable items, said knock-down unit comprising a plurality of insulated outer walls having inwardly extending ribs which create passages for said circulating cooled air, at least one opening through which at least one of said perishable items can be removed, at least one second pair of openings corresponding to said first pair of openings of said refrigeration unit, a plenum having a first set of plenum ribs for diverting said cooled air received through said first opening of said second pair out toward said passages in at least one of said plurality of outer insulated walls, and means for permitting said circulating cooled air to return through a corresponding second opening of said second pair and back to said refrigeration unit.

Preferably, the means for permitting the air to circulate comprises a fan in conjunction with the walls of the knock-down unit having inwardly extending ribs which create passages for the circulating cooled air around the perishable items even if the perishable items completely occupy the usable storage volume. Also, preferably, the air plenum is located in the knock-down unit between the refrigeration unit and a plate. The plate forces the air to be directed by the ribs of the plenum mostly outwardly to the peripheral air passages in the walls. Where the refrigeration unit is located below the disposable display unit, most of the cooled air is forced up the walls of half the disposable display unit, around the top, and down the passages formed by the ribbed walls of the other half of the disposable display unit.

According to the preferred system, the refrigeration unit is arranged with a compressor, condensor coils, and finned evaporator coils to permit the display system to keep perishable items frozen. Regardless of the means for refrigeration, the refrigeration unit should be a reusable item. The separate insulated storage unit, however, is arranged either to be a reusable knock-down item which may be stored in a minimum of space, or a disposable item. In either case, by providing different wall sizes, display units of different shapes and sizes may be manufactured for different perishable items so that optimal use of the storage volume may be had, provided of course that the storage units include duct openings corresponding to those of the refrigeration unit. Moreover, advertising of a promoted product may be had by printing advertising material directly on outer walls of the disposable units or by wrapping the disposable or knock-down units with a printed wrap. Thus, the display system of the invention is seen to provide a self-contained, cost-effective refrigerated display system for perishable items which does not require the attention of store personnel and which is effective in maintaining its refrigeration.

A better understanding of the refrigerated display system of the present invention, and additional advantages and objects of the invention will become apparent to those skilled in the art upon reference to the detailed description and accompanying drawings.

DETAILED DESCRIPTION OF THE PREFERRED EMBODIMENT

Figure 1:
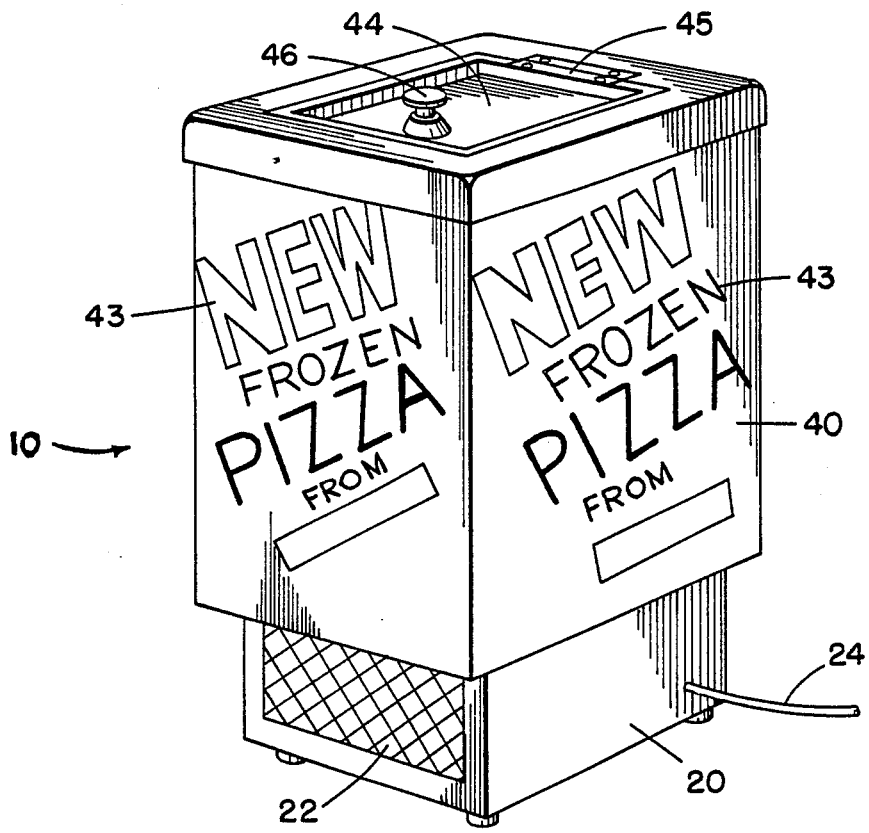
FIG. 1 is a perspective view of an assembled refrigerated display system in accordance with a first embodiment of the invention.

The assembled refrigerated display system 10 in accordance with the invention is seen in FIG. 1 and is seen to include a refrigeration base unit 20, and a disposable insulated storage and display unit 40. One side wall of the refrigeration base unit 20 has a grille 22 for permitting air being pulled across condensor coils to escape. While, if desired, the refrigeration base unit may be powered by a portable generator contained therewith, preferably, the unit is powered by standard electrical wall current. Toward that end, an electrical wire 24 terminating on one end in a plug (not shown) and at the other end in a power supply for a compressor 25 (seen in FIG. 2) is provided.

The disposable insulated storage and display unit 40 as seen in FIG. 1 has printed graphics 43 on all four sides (only two sides being shown) which ostensibly advertise the promoted perishable product being stored in the plenum. A door 44 with plastic hinges 45 (seen in FIG. 3), and with a pull knob 46 is located on the top of the disposable unit 40 and permits the unit to be loaded with the perishable product as well as permitting a consumer to reach inside the unit 40 to obtain the product. As shown in FIG. 1, the disposable unit 40 has a larger cross-sectional area than the cross sectional area of the base unit. Of course, the unit 40 could be of different sizes and shapes, provided that the duct openings in the unit for permitting cooled fluid (in this case air) to circulate correspond to the similar openings in the refrigeration unit 20, and further that some means for supporting the disposable unit 40 and the perishable product to be contained therein is provided. In fact, because the storage and display unit 40 is disposable, it is anticipated that units of different shapes and sizes may be manufactured for different perishable items so that optimal use of the storage volume may be had. Thus, a supplier of perishable items could have a storage and display unit 40 of a desired size with desired graphics printed on the walls (or as a wrap) manufactured to his specifications. For example, a supplier of large frozen pizzas might desire a round storage unit to be manufactured so that the pizzas may be effectively stacked one atop the other. A picture of the pizza and the name of the product might appear on the foam insulating walls of the disposable unit 40.

Figure 2:
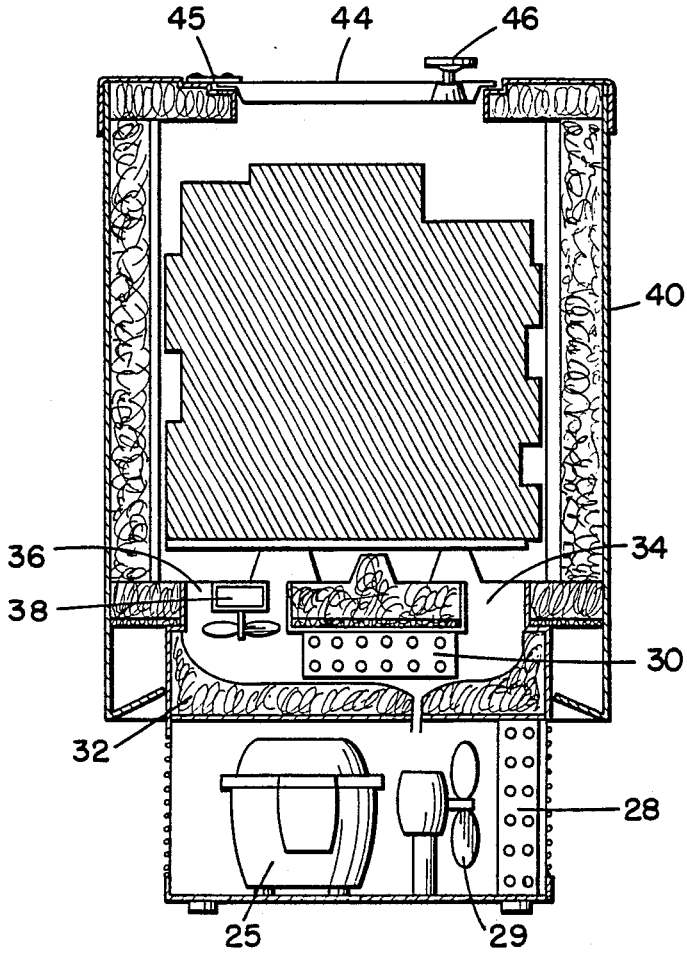
FIG. 2 is a vertical sectional view of the refrigerated display system of FIG. 1.

Turning to the sectional view of FIG. 2, some details of the refrigerated display system are seen. In the preferred embodiment, the means used by the refrigeration unit 20 for cooling the air includes a compressor 25, a condensor 28 and associated fan 29, and evaporator coils 30. As is typical of a refrigeration unit, the compressor 25 takes gas such as freon and pressurizes it, thereby raising its temperature and pressure. This pressurized gas flows to the condensor coil 28. At the condensor coil, air is pulled by fan 29 over the condensor coils to cool the pressurized gas which, as a result, condenses into a liquid. The cooled, pressurized liquid is then pumped to the evaporator coils 30 where the pressure is released. In order to vaporize, the liquid absorbs heat from its surroundings. Because the evaporator coils preferably have large surface areas (e.g. fins) heat is quickly absorbed from the air passing over the fins, thereby cooling the air. The depressurized expanded gas is then returned from the evaporator 30 to the compressor 25 where the gas is then repressurized to complete the closed loop.

The evaporator 30 of the refrigeration unit 20 is preferably contained in a substantially enclosed insulated chamber 32 which includes a first duct 34 through which air flows out of the chamber and into the disposable storage and display unit 40, and a second duct 36 through which air returns from the disposable unit 40 into the chamber 32. In establishing and maintaining the flow of air, a fan 38 is preferably utilized to provide a pressure difference. Thus, air returning from unit 40 through duct 36 is pushed (pulled) across the evaporator 30 where it is cooled, and then pushed out (pulled) through duct 34 into the disposable unit 40. It will be appreciated that for purposes herein, the term "duct" is being used in its broadest sense as an air passage, such that any opening in the chamber 32 through which air may be pulled should be considered a duct even if the opening is not three dimensional.

Figure 3:
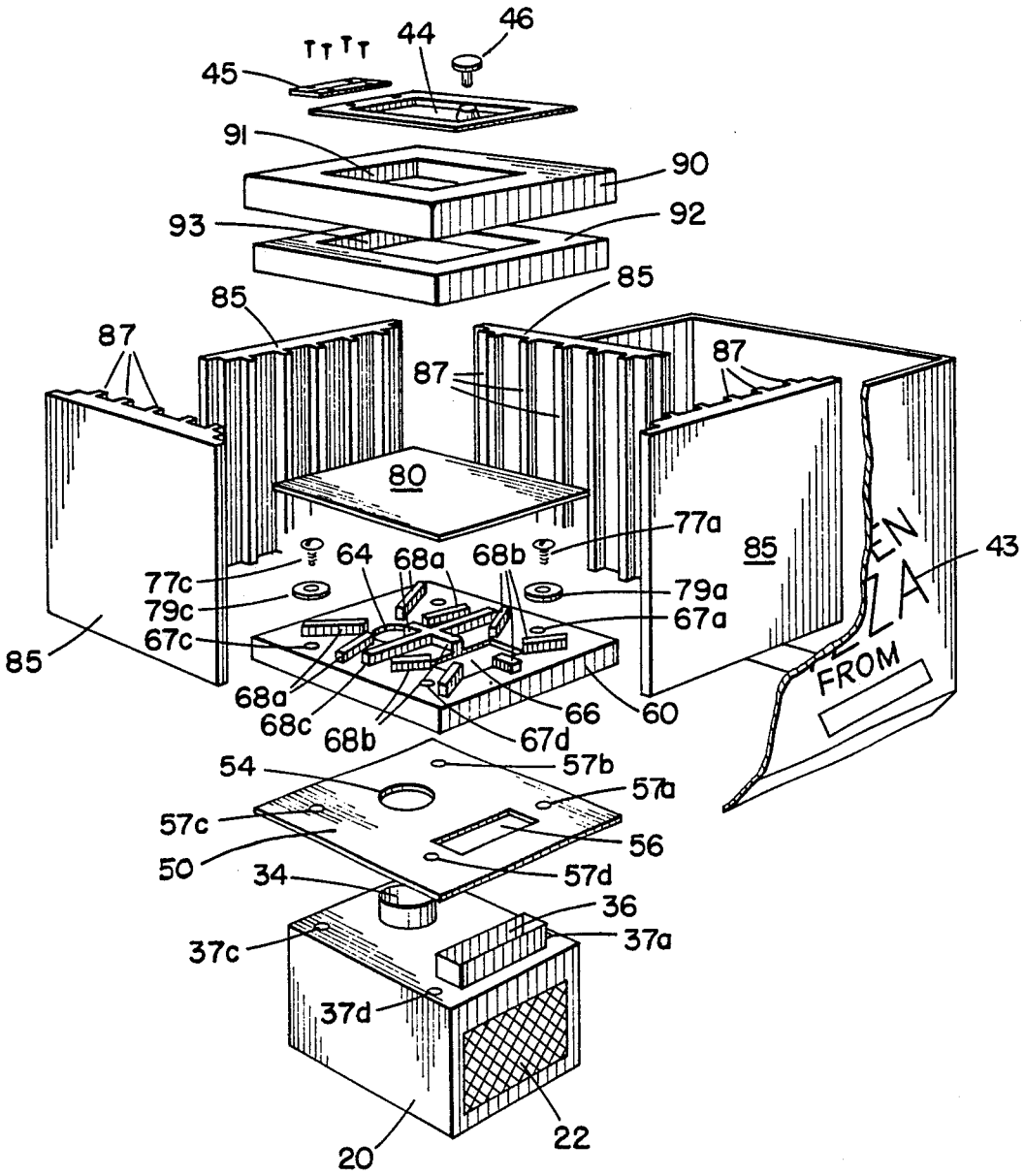
FIG. 3 is a partially exploded perspective view of the disposable insulated storage and display unit and the refrigeration unit of the refrigerated display system of the first embodiment of FIG. 1.

Turning to FIG. 3, the details of the disposable insulated storage and display unit 40 are seen. The base 50 of unit 40 is preferably made out of corrugated cardboard which is cut to a desired shape and size. Cut out of the cardboard are openings or "ducts" 54 and 56 which cooperate with and correspond to ducts 34 and 36 of the refrigeration unit 20 to permit air to flow therethrough. Also preferably provided are holes 57*a*, 57*b*, 57*c*, and 57*d* which correspond to similar holes 37*a*—37*d* (hole 37*b* not shown) in the refrigeration unit 20 through which plastic screws 77*a*—77*d* (screws 77*b* and 77*d* not shown) can extend so as to hold the disposable unit 40 in place with respect to the refrigeration unit 20. The corrugated base 50 is preferably die cut to order.

Directly above the corrugated base 50, is an insulated plate 60 having "duct" openings 64 and 66 which correspond to the ducts of the base plate 50 and the ducts of the refrigeration unit 20, and holes 67*a*—67*d* (hole 67*b* not shown) which correspond to holes 57*a*—57*d* and 37*a*—37*d*. As aforementioned, plastic screws 77*a*—77*d*, which may be used with washers 79*a*—79*d* (washers 79*b* and 79*d* not shown), are extended through holes 67*a*—67*d* so as to hold the disposable unit 40 in place relative to the refrigeration unit 20. Insulated plate 60 also has groups of ribs 68*a*, and 68*b*, and a divider rib 68*c* which act in conjunction with corrugated plate 80 as a plenum to direct the cooled air in desired directions. Thus, cooled air forced out of refrigeration unit 20 through duct 34, proceeds through ducts 54 and 64, and is forced towards the periphery of the disposable storage and display unit 40 by the air passages formed by ribs 68*a*, plate 60 and plate 80. As indicated, divider rib 68*c* acts to cause substantially all of the incoming cooled air to stay in a half plane; i.e. the incoming air is sent to the peripheral walls comprising half of the outside walls of the disposable unit 40. As will be discussed hereinafter, ribs 68*b* conversely act to direct the air returning from the walls of the other half plane of unit 40 into duct 66 for return through ducts 56 and 36 to the refrigeration unit.

The walls 85 of storage and display unit 40 are preferable relatively thick insulated interlocking polystyrene foam panels which have inwardly extending ribs 87. The provision of ribs 87 provides channels through which the cooled air may circulate about the perishable items which are stacked atop corrugated plate 80. Without ribs 87, if the storage area of disposable unit 40 were completely filled with perishable items, there might be little room for the cool air to circulate and keep the perishable items refrigerated. However, with longitudinally extending ribs 87, the cooled air is free to flow up the walls 85, provided the perishable items are not small enough to extend between the ribs. Thus, the cooled air is permitted to envelop the perishable items, keeping them refrigerated. If desired, the channels formed by ribs 87 may be enclosed by adding walls which are substantially coplanar to and internal the outer walls 85. The channels may be enclosed along part or even all of the walls in either or both of the walls handling the outgoing and returning air. Such a closed channel arrangement provides a partial or complete vertical plenum which could provide more direction to the air flow, if desired.

Sitting atop the walls 85 of disposable unit 40 is a top cover 90 and associated insulation 92. Cover 90 has a central cut-out 91 for permitting the perishable items to be loaded into and removed from the storage and display unit 40. Insulation 92 also includes a central cut-out 93. Central cut-out 91 of cover 90 is formed to accept door 44 and hinge 45 which connects the door 44 to the top cover 90. Door 44 is preferably of a thermopane construction with a vinyl bottom, and snugly sits in cover 90 so as to block the exit and entrance of air therethrough except when opened.

Figure 4:
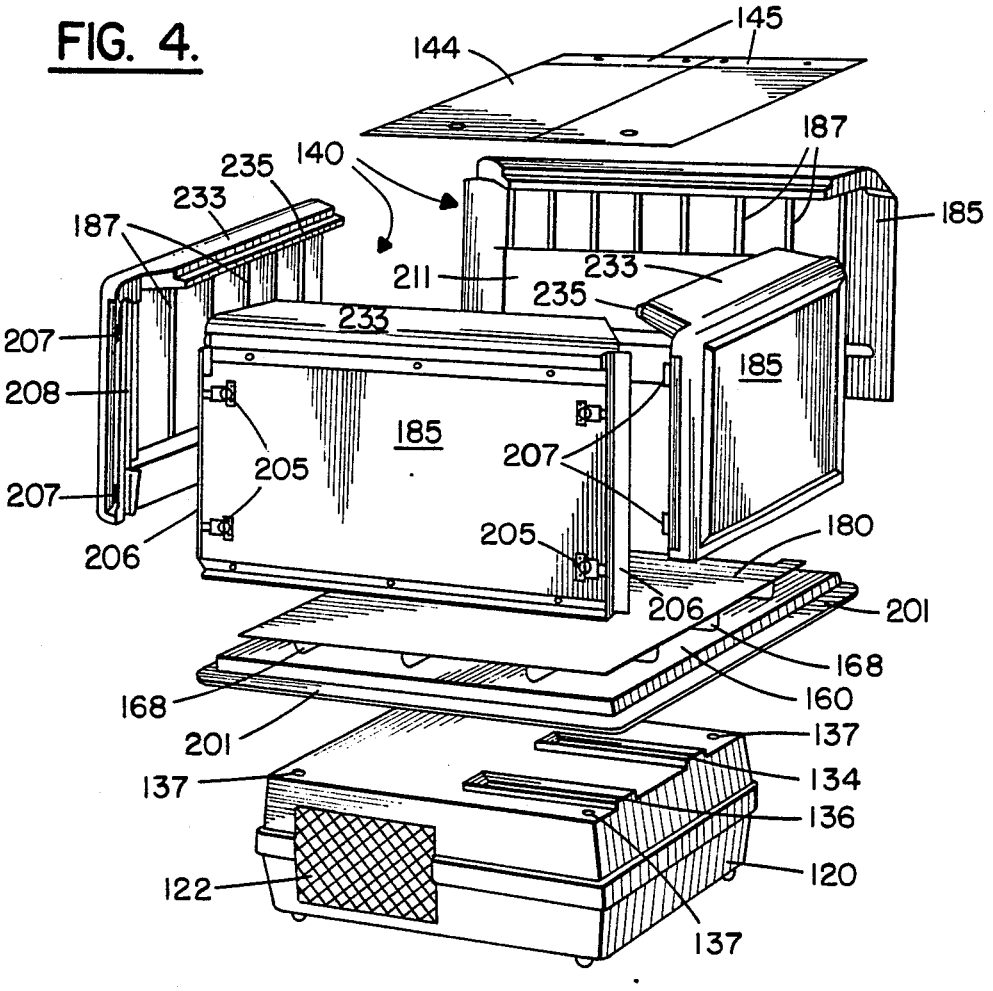
FIG. 4 is a partially exploded perspective view of the knock-down insulated storage and display unit and the refrigeration unit of a second embodiment of the invention.
Figure 5A:
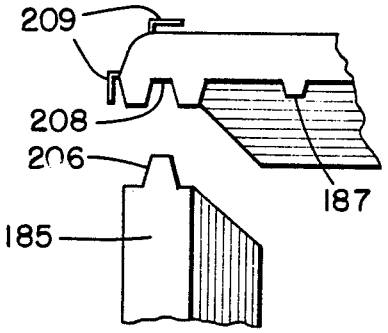
FIGS. 5*a* and 5*b* are horizontal and vertical sections respectively through perpendicular side walls showing a tongue and groove arrangement for connecting the side walls, and through a side wall and a plenum showing the tongue and groove arrangement for connecting the side wall to the plenum in the second embodiment of the invention.
Figure 5B:
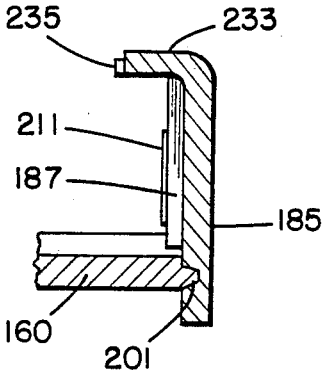

The knock-down but non-disposable embodiment of the invention is seen in FIGS. 4, 5*a* and 5*b* where parts identical or similar in function to those of FIG. 3 are given numbers which are removed by "100". As is readily apparent, the refrigeration unit 120 of FIG. 4 is almost identical to unit 20 of FIG. 3 as it includes grille 122, first duct 134 for outgoing air, second duct 136 for incoming air, and holes 137 for attachment purposes. The minor illustrated difference between the refrigeration units is simply the shape and location of first duct 134.

In the embodiment of FIG. 4 having reusable knock-down side walls 185, the base 160 of unit 140, as well as the side panels 185 and plenum top panel 180 are preferably made out of rotationally molded polyethylene which is hollow and filled with foam to provide resilient, insulative components. The base 160 and top panel 180 are preferably plastic welded or riveted to ribs 168 to create a singular diverting plenum unit with duct openings (not shown) corresponding to ducts 134 and 137 of the refrigeration unit. The plenum unit also preferably includes holes (not shown) which line up with holes 137 of the refrigeration unit 120 for fastening purposes. The base 160 of the plenum preferably extends past the edges of the refrigeration unit and includes a lip or tongue portion 201 for connecting to the side walls 185 as will be described hereinafter. The top panel 180 of the plenum, on the other hand, does not extend as far as the base 160, but rather is sized to abut the inwardly extending ribs 187 of the side walls 185. In this manner, air which is forced into the plenum is diverted by the plenum to and up some of the side walls 185.

Side walls 185 are preferably constructed in pairs to desired sizes, and preferably correspond to different sized plenums. In order to facilitate assembly, the bottoms of the side walls 185 may contain grooves into which tongue portion 201 of plenum base 160 extends (as best seen in FIG. 5*b*) so that the walls 185 and plenum are connected and relatively air-tight. Also, in order to facilitate abutment of the side walls, one pair of parallel walls are provided with link lock latches 205 such as part #2-57-1735-07-00, manufactured by Simmons Fastener Co. of Albany, NY, and tongues 206 on both ends of the wall. The pair of perpendicular walls are correspondingly provided with keeper plates or catches 207 and grooves 208. The tongues 206 are arranged to fit into the grooves 208 (as best seen in FIG. 5*a*), and assembly is easily accomplished by placing the tongues into the grooves and then latching the latches 205 onto the catches 207 and tightening. If desired, gaskets (not shown) may be located in the grooves 208 to facilitate larger manufacturing tolerances. It should be appreciated however, that other abutment facilitating means such as screw or bolts or the like could be utilized for holding the walls, and the walls and plenum together.

Preferably, the latches and keeper plates are sunk into the side walls 185. In this manner, extrusions 209 may be provided on two or more side walls so that advertising material may be accommodated, with the latches and catches resultingly obscured. Also, preferably, at least one of the side walls along which air is to be returned includes a back panel 211 which extends at least partly up the wall, creating a vertical plenum.

As indicated in FIGS. 4 and 5*b*, each side wall 185 also preferably includes an inwardly and upwardly extending portion 233 having lip portions 235. The extending portions 233 each preferably have forty-five degree abutting surfaces and together essentially comprise a top section for receiving at least one lid 144 sized to fit therein. The lid 144 is attached to the lip portion 235 of one side wall 185 by hinge 145.

There has been described and illustrated herein preferred refrigerated display systems. While a particular embodiments of the invention have been described, it is not intended that the invention be limited thereby, as it is intended that the invention be as broad in scope as the art will allow. Thus, while the invention was described as having a refrigeration unit which utilizes a compressor, condensor, and evaporator, those skilled in the art will appreciate that other means for cooling air (such as a thermoelectric device) could be utilized. Similarly, while the disposable unit was described as utilizing corrugated cardboard and foam, and the non-disposable knock-down unit in place thereof was described as utilizing rotationally molded polyethylene, other insulative materials could be utilized. Further, it will be appreciated that while a plenum of the disposable unit was described as using rib means extending from plates (and the walls were described as using ribs) for distributing the cooled air around the perishable items, other means for distributing the air could be utilized. In fact, while the results would be inferior, the cooled air could be forced to circulate around the disposable unit by passing through air gaps between the stored perishable items if desired. Thus, for example, instead of utilizing an air plenum, a perforated plate could be used to both act as a base for holding the perishable items and as a means or permitting the air to rise out of duct 34 and back through duct 36.

Another change to the preferred arrangements which would be considered within the scope of the invention would be to locate the disposable (knock-down) unit adjacent the refrigeration unit in a side-by-side manner, or even having the disposable unit below the refrigeration unit rather than having the refrigeration unit below the plenum as shown. Clearly, the ducting of the air would have to be changed to accommodate the same. It will further be appreciated that the ducting of the air could be changed and still be within the scope of the invention. For example, rather than having the cooled air rise along half of the perimeter of the disposable unit, and descend along the other half, different percentages (other than 50—50) for rising and descending along the periphery could be utilized as well as different arrangements (e.g. interleaved sections). Indeed, as previously implied, the disposable unit need not even be divided into different sections such that the cooled air rises along one section and descends along the other. Further, it will be appreciated that the "door" to the disposable unit can take many forms and locations, and is intended to be understood broadly to include any means which may be opened to give access to the storage area of the disposable unit and then shut to prevent the cooled air from escaping. In fact, a door is not even necessary in certain circumstances as the air loss through a provide opening would not necessarily render the system inoperable. Likewise, it will be appreciated that while the terminology used herein has referred to "refrigeration" and "refrigerated", those terms are intended to encompass freezing also. Indeed, with the preferred embodiment described herein, temperatures of minus ten degrees F are definitely maintainable. Similarly, terms such as fluid or air flow "about" the storage unit is to be broad language intended to encompass peripheral flow as well as flow through the middle of the unit.

Yet another arrangement within the scope of the invention is to utilize another gas or a liquid cooling means rather than air. Where a liquid is used, tubing is preferably provided as the means for permitting the fluid to circulate, as well as providing a manner for eliminated leaks. Therefore, it will be apparent to those skilled in the art that yet other changes and modifications may be made to the invention as described without departing from the scope of the invention as so claimed.

I claim:

1. A refrigerated system for perishable items, comprising:

(a) a refrigeration unit comprising a cooling means for cooling air, a circulation means for causing said cooled air to be circulated through an insulated knock down storage unit, and at least a first pair of openings in said refrigeration unit for permitting cooled air to flow out of said refrigeration unit through a first opening of said first pair and for permitting returning air to be received in said refrigeration unit via a second opening of said first pair; and (b) said insulated knock-down storage unit separate from said refrigeration unit comprised of a plurality of separate walls having means for facilitating abutment one to another and having inwardly extending ribs which create passages for circulating cooled air, and a plenum having a first set of plenum ribs for diverting said cooled air from said refrigeration unit to at least one of said plurality of separate walls, wherein said separate walls and said plenum when assembled provide a volume for storing said perishable items, said knock down unit comprising at least one opening through which at least one of said perishable items can be removed, and at least a second pair of openings corresponding to said first pair of openings of said refrigeration unit.

2. A refrigerated system according to claim 1, wherein:

said insulated knock-down storage unit further comprises means for receiving and displaying printed material associated with said perishable items on at least one of said separate walls.

3. A refrigerated system according to claim 1, wherein:

said plurality of separate walls comprises four side walls, and said means for facilitating abutment comprises at least one of latch and catch means, and a tongue and groove means on a pair of abutting separate walls.

4. A refrigerated system according to claim 3, wherein:

a first opening of said second pair is in said plenum such that cooled air received through said first opening of said second pair is diverted by said first set of plenum ribs out toward said passages in said outer insulated walls.

5. A refrigerated system according to claim 4, wherein:

said plenum further comprises at least one dividing plenum rib for substantially dividing said walls of said knock-down unit into two air flow sections.

6. A refrigerated system according to claim 5, wherein:

said plenum further comprises at least a second set of plenum ribs for diverting cooled air which has circulated about said knock-down unit to said second opening of said second pair and back to said refrigeration unit.

7. A refrigerated system according to claim 6, wherein:

said plenum further comprises a top insulated plenum plate on which said perishable items may be stored, and a bottom insulated plenum plate, said plenum ribs extending between said top and bottom insulated plenum plates.

8. A refrigerated system according to claim 7, wherein:

said disposable unit further comprises a top insulated section including a door means, wherein said door means is arranged to cover said opening through which at least one perishable item may be removed from said disposable unit.

9. A refrigerated system according to claim 4, wherein:

said cooling means comprises a compressor, condensor coils, and evaporator coils, said refrigeration unit further comprises a substantially enclosed chamber which includes said first pair of openings, such that said enclosed chamber and said knock-down unit comprise a substantially closed air circulation system.

10. A refrigerated system according to claim 8, wherein:

said cooling means comprises a compressor, condensor coils, and evaporator coils, said refrigeration unit further comprises a substantially enclosed chamber which includes said first pair of openings, such that said enclosed chamber and said knock-down unit comprise a substantially closed air circulation system.

11. A refrigerated system according to claim 3, wherein:

said insulated knockdown storage unit further comprises means for receiving and displaying printed material associated with said perishable items on at least one of said separate walls.

12. A refrigerated system according to claim 6, wherein:

said insulated knock-down storage unit further comprises means for receiving and displaying printed material associated with said perishable items on at least one of said separate walls.

13. A refrigerated system according to claim 11, wherein:

said disposable unit further comprises a door means arranged to cover said opening through which at least one perishable item may be removed from said disposable unit.

14. A refrigerated system according to claim 1, further comprising:

means for readily attaching and detaching said knock-down insulated storage unit to and from said refrigeration unit.

15. A refrigerated system according to claim 3, further comprising:

means for readily attaching and detaching said knock-down insulated storage unit to and from said refrigeration unit.

16. A refrigerated system according to claim 5, further comprising:

means for readily attaching and detaching said knock-down insulated storage unit to and from said refrigeration unit.

17. A refrigerated display system for perishable items, comprising:

(a) a refrigeration unit comprising a cooling means for cooling fluid, a circulation means for causing said cooled fluid to be circulated through an insulated knock-down storage unit, and at least a first pair of openings in said refrigeration unit for permiting cooled fluid to flow out of said refrigeration unit through a first opening of said first pair and or permitting returning fluid to be received in said refrigeration unit via a second opening of said first pair; and (b) at least a first, a second, and a third pair of insulated side walls, and a first and second plenum, said first plenum corresponding in size to the lengths of said first and second pairs of side walls, and said second plenum corresponding in size to the lengths of said first and third pair of side walls, said third pair of side walls being different in length than said second pair of side walls, said first and second pair of side walls having means for facilitating abutment one to another and together with said first plenum comprising a first said insulated knock-down storage unit, said third pair of side walls having similar said means for facilitating abutment to said second pair of side walls, and said first and third pair of side walls and said second plenum comprising a second said insulated knock-down storage unit, each said insulated knock-down storage unit arranged for being placed together with said refrigeration unit, and for storing said perishable items, and adapted for being knocked down and removed from said refrigeration unit, and replaced with the other of said knock-down insulated storage unit, each said knock-down insulated storage unit further comprising at least one opening through which at least one of said perishable items can be removed, at least a second pair of openings corresponding to said first pair of openings of said refrigeration unit, means for permitting said cooled fluid passing through a first opening of said second pair to circulate about said knock-down unit before passing through a corresponding second opening of said second pair and back to said refrigeration unit.

18. A refrigerated system according to claim 17, further comprising:

(c) means for readily attaching said insulated knock-down storage units to said refrigeration unit, wherein said means for readily attaching permit easy detaching of said knock-down storage units from said refrigeration unit, and wherein said means for facilitating abutment comprises at least one of latch and catch means, and a tongue and groove means on said pairs of insulating walls.

19. A refrigerated system according to claim 18, wherein:

said cooled fluid is air;

said circulation means of said refrigerated unit is a fan; and said means for permitting said cooled fluid to circulate about comprises at least one of one of the pairs of walls of said knock-down unit having inwardly extending ribs which create passages for circulating cooled air, and a plenum having a first set of plenum ribs for diverting said cooled air received through said first opening of said second pair out toward said passages in said outer insulated walls.

20. A refrigerated system according to claim 19, wherein:

said plenum further comprises at least one dividing plenum rib for substantially dividing the walls of said knock-down units into two air flow sections, a top insulated plenum plate on which said perishable items may be stored, and a bottom plenum plate through which said first opening of said second pair extends, each said unit further comprising a door means arranged to cover said opening through which at least one perishable item may be removed from said knock-down unit.

* * * * *